US012298041B2

(12) United States Patent
Hofmann

(10) Patent No.: US 12,298,041 B2
(45) Date of Patent: May 13, 2025

(54) HEATING SYSTEM

(71) Applicant: Mammoth Holdings LLC, Santa Barbara, CA (US)

(72) Inventor: Matthew Hofmann, Santa Barbara, CA (US)

(73) Assignee: MAMMOTH HOLDINGS LLC, Santa Barbara, CA (US)

( * ) Notice: Subject to any disclaimer, the term of this patent is extended or adjusted under 35 U.S.C. 154(b) by 824 days.

(21) Appl. No.: 17/548,461

(22) Filed: Dec. 10, 2021

(65) Prior Publication Data

US 2022/0186980 A1 Jun. 16, 2022

Related U.S. Application Data

(60) Provisional application No. 63/123,508, filed on Dec. 10, 2020.

(51) Int. Cl.

| | |
|---|---|
| ***F24H 4/04*** | (2006.01) |
| ***F24D 3/14*** | (2006.01) |
| ***F24D 11/02*** | (2006.01) |
| ***F24H 9/14*** | (2006.01) |

(52) U.S. Cl.

CPC ..... *F24H 4/04* (2013.01); *F24D 3/145* (2013.01); *F24D 11/0214* (2013.01); *F24H 9/142* (2013.01); *F24H 9/148* (2013.01)

(58) Field of Classification Search

CPC ..... F24D 3/145

See application file for complete search history.

(56) References Cited

U.S. PATENT DOCUMENTS

| | | | | | |
|---|---|---|---|---|---|
| RE323 | E | * | 8/1855 | Rutton | 237/28 |
| 1,837,905 | A | * | 12/1931 | Hart | F28D 1/05333 165/181 |
| 2,478,620 | A | * | 8/1949 | Arnold | F24D 3/145 165/57 |
| 2,587,871 | A | * | 3/1952 | May | B60P 3/32 298/1 H |
| 2,595,613 | A | * | 5/1952 | Spencer | B60P 3/32 237/43 |
| 2,998,004 | A | * | 8/1961 | Eberhart | F24H 3/065 126/117 |
| 3,259,318 | A | * | 7/1966 | Eberhart | F24D 5/02 126/307 R |
| 3,419,215 | A | * | 12/1968 | Riedel | B60H 1/00364 237/28 |
| 3,482,503 | A | * | 12/1969 | Jenn | F24F 7/06 454/260 |
| 11,092,350 | B1 | * | 8/2021 | Stevenson | F24F 7/10 |
| 2017/0248323 | A1 | * | 8/2017 | Thomas | F24D 3/145 |
| 2019/0145632 | A1 | * | 5/2019 | Thomas | F24H 3/08 52/173.1 |

* cited by examiner

*Primary Examiner* — Avinash A Savani
*Assistant Examiner* — Deepak A Deean
(74) *Attorney, Agent, or Firm* — Heidi Eisenhut; LOZA & LOZA, LLP

(57) ABSTRACT

Embodiments of the invention are directed to a hydronic heating system utilized to heat a mobile living unit. The mobile living unit may include a bottom floor and a raised floor separated by a conditioned basement which funnels cold air from the conditioned basement through a convector. The convector heats the air causing the air to rise through the walls in the mobile living unit. The warm air is then released out through one or more vents in the walls into the interior living space of the mobile living unit.

12 Claims, 5 Drawing Sheets

HEATING SYSTEM

CLAIM OF PRIORITY

The present Application for Patent claims priority to U.S. Provisional Application No. 63/123,508 entitled "HEATING SYSTEM", filed Dec. 10, 2021, the entire contents of which is incorporated herein by reference as if fully set forth below in its entirety and for all applicable purposes.

FIELD

At least one feature pertains to a heating system for a mobile living space, more specifically to a hydronic heating system and method for recreational vehicles (RV).

BACKGROUND

Hydronic heating is an energy efficient heating system that utilizes tubing which allows hot liquid to run beneath the floor, along base board heaters, or through radiators to heat a space. The hot liquid is passed through heat exchangers that disperse heated air into living areas. A variety of heat sources can be used. With RVs, most use a combination of the vehicle's engine surplus heat, diesel fuel or propane and AC shore power.

A hydronic heating system that does not use a vehicle's engine surplus heat, diesel fuel or propane and AC shore power is needed.

SUMMARY

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure in a form as a prelude to the more detailed description that is presented later.

According to one aspect, a mobile living unit is provided. The mobile living unit comprises a roof; a bottom surface including one or more floor joists; and a plurality of walls integrally connected and extending between the roof and the one or more floor joists forming an interior space. At least one wall in the plurality of walls comprises a plurality of studs; an exterior wall surface secured to an outer surface of the studs; insulation located between studs in the plurality of studs; one or more hollow members extending vertically upward along the insulation; an interior wall surface secured to the hollow member; and one or more vents located within the interior wall surface.

The mobile unit further includes a raised floor extending parallely above the bottom surface between plurality of walls; a conditioned basement located between the bottom surface and the raised floor; a support member connected to the plurality of studs and the one or more floor joists; and at least one convector located within the conditioned basement and secured to the support member.

According to one feature, the one or more hollow members are aluminum tube spacers.

According to another feature, the mobile living unit further comprises an access panel detachably secured to the interior skin and the interior wall surface and the raised floor.

According to yet one feature, the outer wall surface is comprised of anodized aluminum.

According to yet another feature, the inner wall surface is comprised of aluminum.

According to yet another feature, air flows from the conditioned basement, through the convector, up through the hollow member and out the plurality of vents, heating an interior space.

According to yet another feature, air is drawn into the convector from between the floor joists warming a floor in an interior space.

According to another aspect, a mobile living unit is provided. The mobile living unit comprises a roof; a bottom surface; a plurality of walls integrally connected and extending between the roof and the bottom surface forming an interior space; a plurality of vents located within the plurality of walls; a raised floor extending transversely across the bottom surface and between the plurality of walls; a conditioned basement located between the bottom surface and the raised floor; at least one convector located within the conditioned basement; wherein each wall in the plurality of walls has an interior surface and an opposing exterior surface; wherein building insulation is located between the exterior surface and the interior surface; wherein a gap is formed between the building insulation and the interior surface; and wherein air flows from the conditioned basement, through the convector, up through the gap and out the plurality of vents, heating the interior space.

BRIEF DESCRIPTION OF THE DRAWINGS

The accompanying drawings are provided together with the following descriptions of embodiments for a better comprehension of the present inventions. The drawings and the embodiments are illustrative of the present inventions and are not intended to limit the scope of the present inventions. It is understood that a person of ordinary skill in the art may modify the drawings to generate drawings of other embodiments that would still fall within the scope of the present inventions.

DETAILED DESCRIPTION

In the following description, specific details are given to provide a thorough understanding of the described implementations. However, it will be understood by one of ordinary skill in the art that the implementations may be practiced without these specific details. For example, well-known structures may not be shown in detail in order not to obscure the implementations of the subject matter disclosed herein.

While the present invention is described primarily with respect to mobile living units, the present invention may be applied and adapted to any space where there is a need for heating. Also, a variety of other embodiments are contemplated having different combinations of the below described features of the present invention, having features other than those described herein, or even lacking one or more of those features. As such, it is understood that the invention can be carried out in various other suitable modes.

In one embodiment, the systems described herein may be used with structures including structures that are used as or include living quarters. For example, the systems may be used with any of the mobile and immobile structures previously described which may be used as living quarters. Structures which may be used as living quarters include, but are not limited to, homes, houses, residences, condominiums, abodes, dwellings, lodgings, recreational vehicles. Recreational vehicles may include, but are not limited to, travel trailers, fifth wheels, truck campers, motor homes, houseboats, cruise ships, or any other mobile living unit.

In another embodiment, any structure which is suitable for or designed principally for habitation by people either on a permanent (e.g., a house) or a temporary (e.g., hotel) basis may be used with the described and illustrated systems.

The following detailed description is of the best currently contemplated modes of carrying out the invention. The description is not to be taken in a limiting sense but is made merely for the purpose of illustrating the general principles of the invention.

Overview

Embodiments of the invention are directed to a hydronic heating system utilized to heat a mobile living unit. The mobile living unit may include a bottom surface and a raised floor separated by a conditioned basement, described below, which funnels cold air from the conditioned basement through a convector. The convector heats the air causing the air to rise through the walls in the mobile living unit. The warm air is then released out through one or more vents in the walls into the interior living space of the mobile living unit.

Figure 1:
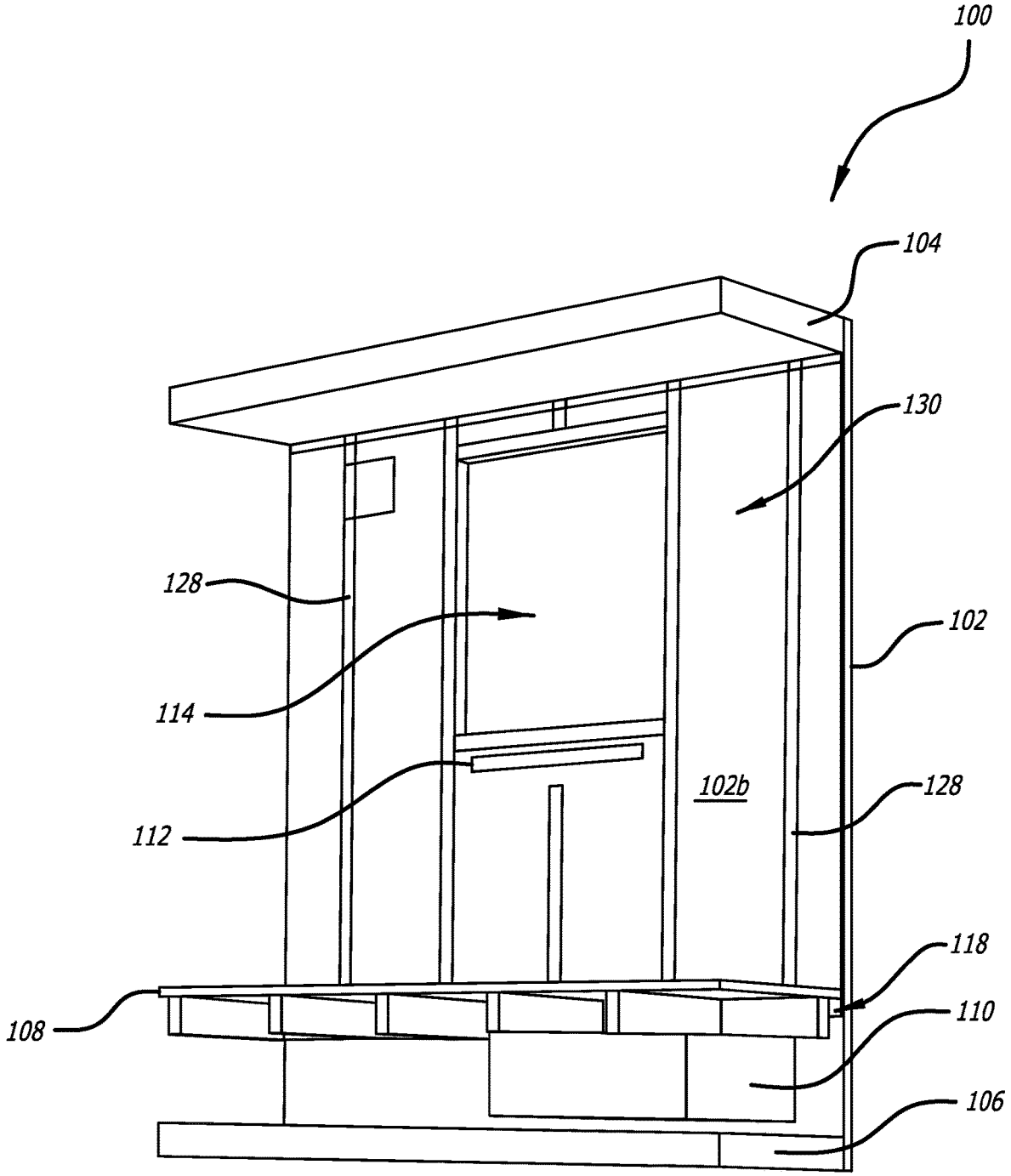
FIG. 1 illustrates a perspective view of an interior wall section of a mobile living unit, according to one embodiment.
Figure 2:
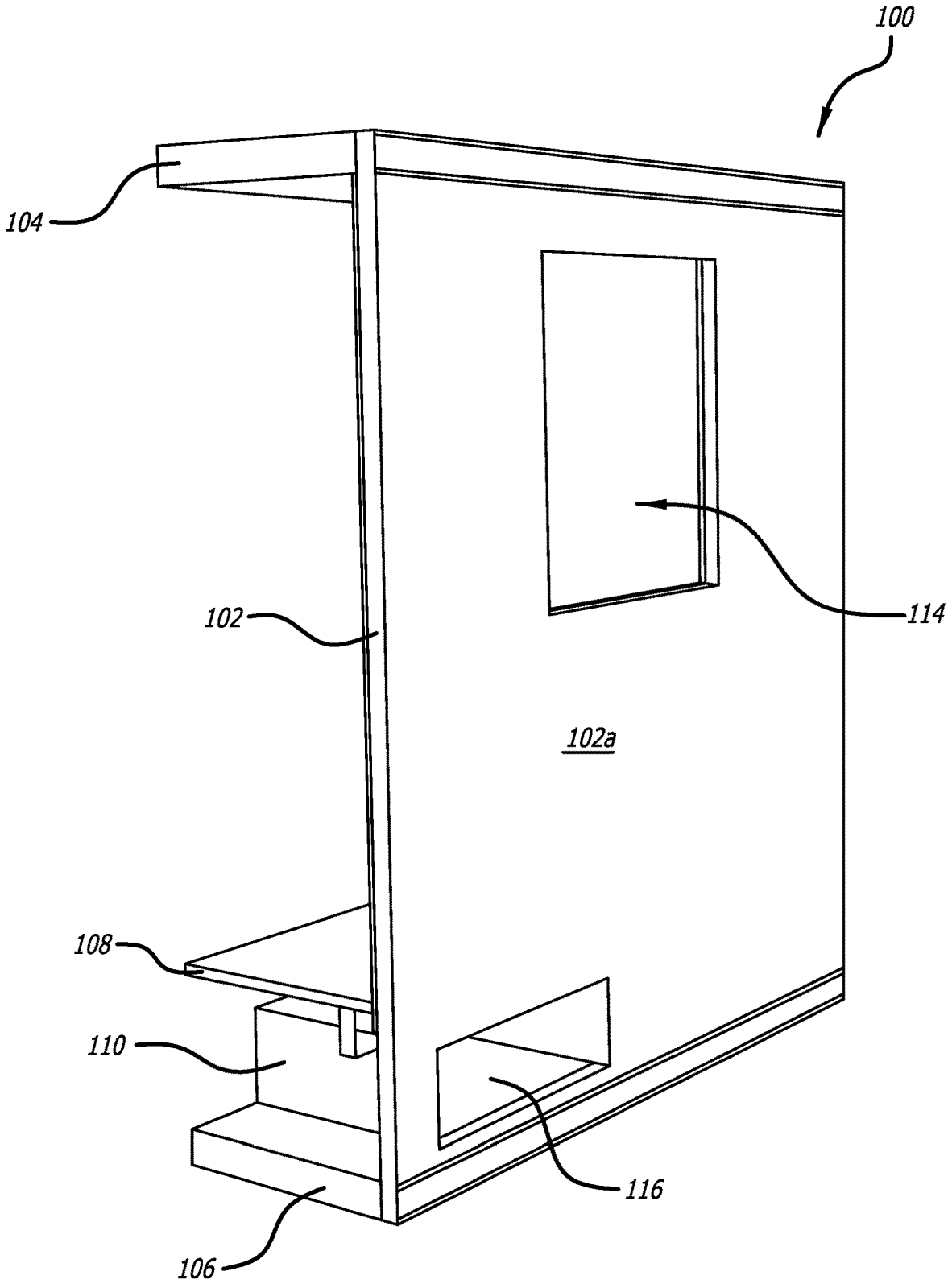
FIG. 2 illustrates a perspective view of an exterior wall section of a mobile living unit, according to one embodiment
Figure 3:
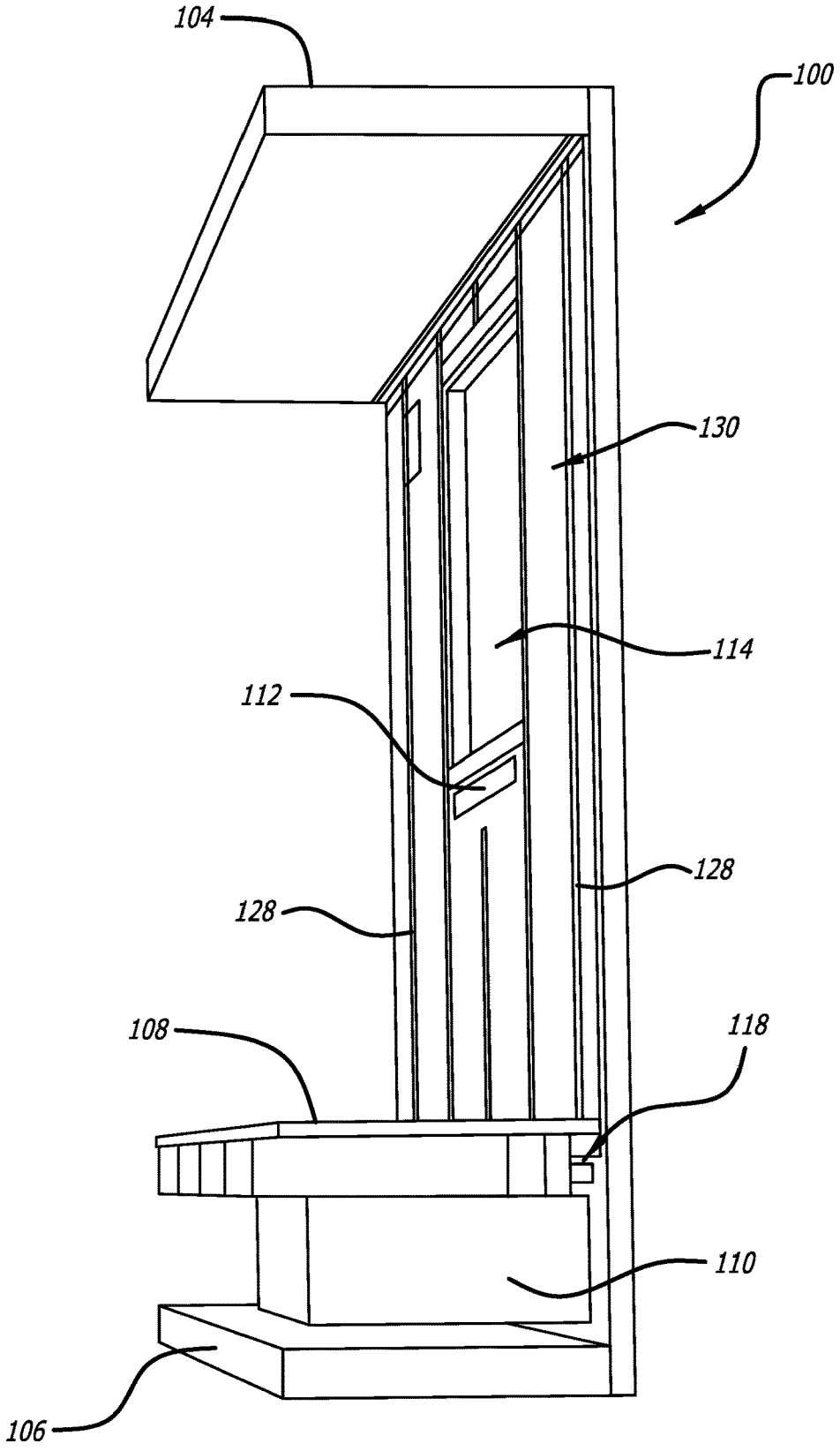
FIG. 3 illustrates a perspective view of an interior wall section of a mobile living unit, according to one embodiment.
Figure 4:
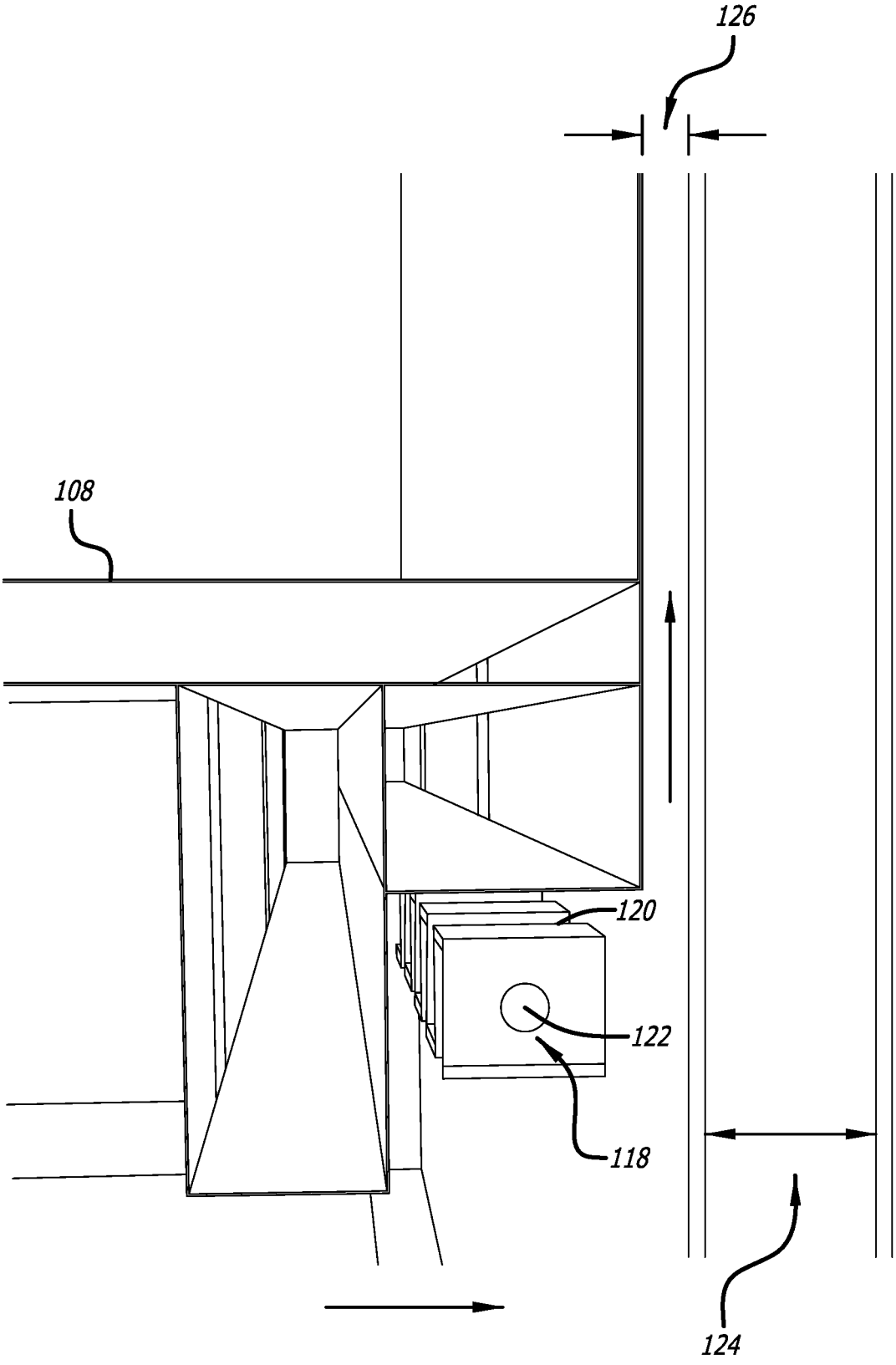
FIG. 4 illustrates a fragmentary view of a hydronic heating system in a mobile living unit, according to one embodiment.
Figure 5:
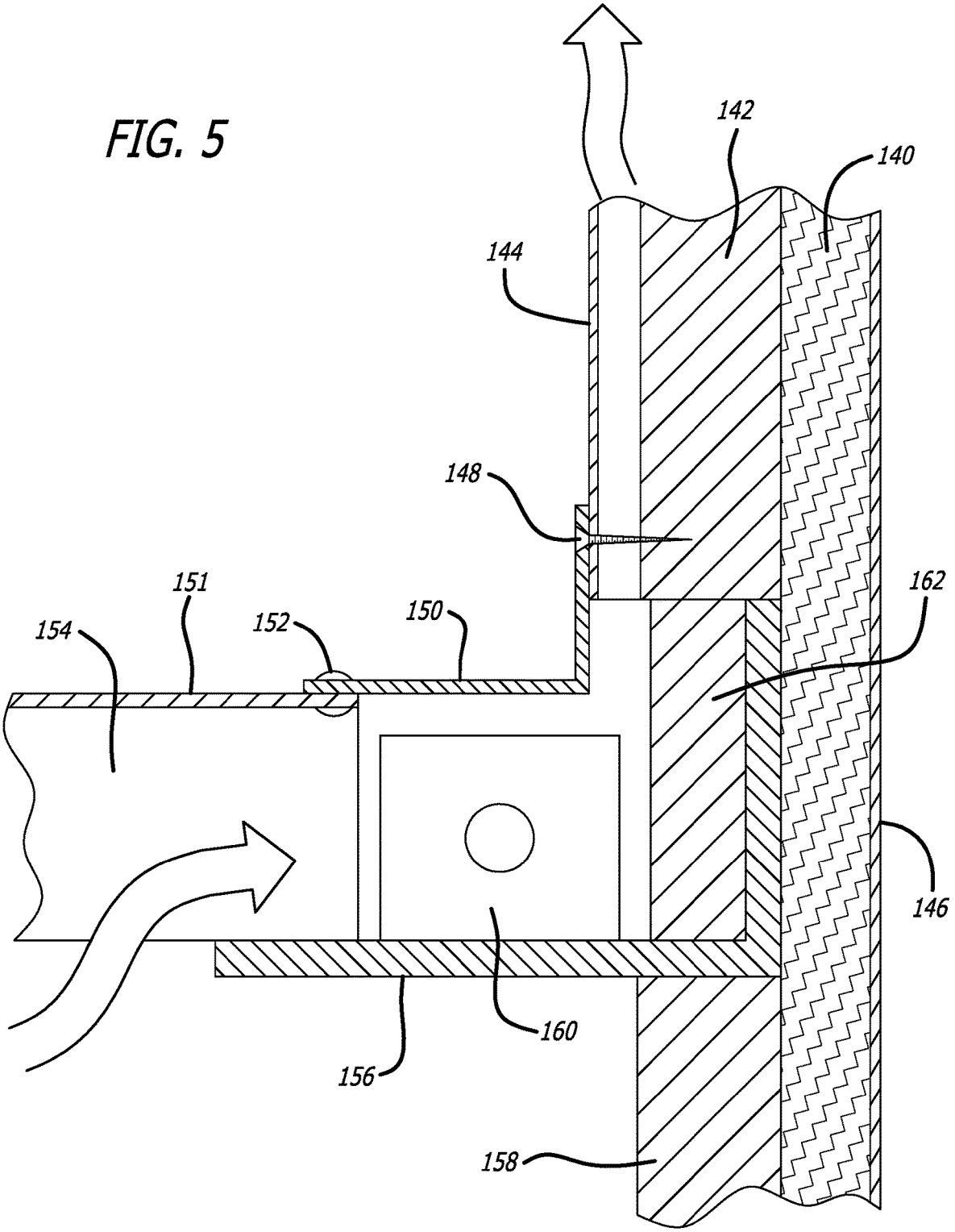
FIG. 5 illustrates a cross-sectional view of a hydronic heating system in a mobile living unit, according to one embodiment.

FIG. 1 illustrates a perspective view of an interior wall section of a mobile living unit, according to one embodiment. FIG. 2 illustrates a perspective view of an exterior wall section of a mobile living unit, according to one embodiment. FIG. 3 illustrates a perspective view of an interior wall section of a mobile living unit, according to one embodiment. FIG. 4 illustrates a fragmentary view of a hydronic heating system in a mobile living unit, according to one embodiment. FIG. 5 illustrates a cross-sectional view of a hydronic heating system in a mobile living unit, according to one embodiment. The following discussion refers interchangeably to FIGS. 1-5.

FIGS. 1-5 illustrate various fragmentary views of an internal and external structure of a mobile living unit, such as a recreational vehicle. For example, FIG. 1 illustrates a fragmentary view of the internal structure of a section of a wall of a mobile living unit 100 while FIG. 2 illustrates a fragmentary view of the external structure of the section of the wall of the mobile living unit 100. As shown, the wall section of the mobile living unit 100 comprises a wall 102 having an exterior wall surface 102*a* and an interior wall surface 102*b* extending between a roof 104 and an underside or bottom surface 106 of the mobile living unit 100. One or more windows 114 may be located in walls of the mobile living unit 100.

A raised floor 108 extends parallely above the bottom surface 106 of the mobile living unit 100 between the walls 102 of the mobile living unit 100, only one of which is shown. A space, area or conditioned basement 110 is located between the bottom surface 106 of the mobile living unit 100 and the raised floor 108. Utilities and other infrastructure may be located within the conditioned basement 110 of the mobile living unit 100. The utilities and infrastructure may include, but are not limited to, plumbing and electrical to allow the mobile living unit 100 to be utilized during all four seasons of the year. That is, the mobile living unit 100 can be used during the Winter, Spring, Summer, and Fall seasons.

Hydronic heating may be utilized to heat the mobile living unit 100. The hydronic heating system includes a convector 118 which provides warm air to the interior of the mobile living unit or other structure. The convector includes a pipe or tube 122 extending longitudinally through a plurality of radiator fins 120. In typical systems, the convector 118 is placed along the baseboard, typically 6 inches up the wall and then the convector 118 is typically covered with cabinets. The convector 118 draws air from underneath the cabinets in the interior living space of the mobile living unit 100 and up the back of the cabinets heating the interior living space.

However, unlike prior art systems, the heating system of the present invention utilizes air from the conditioned basement 110. As shown in the figures, the convector 118 is located between the raised floor 108 and the bottom surface of the mobile living unit 100 in the conditioned basement 110. Air is drawn from the conditioned basement 110 through the convector 118 where it is heated causing the air to travel up through the wall 102 and out one or more vents 112 in the interior space of the mobile living unit 100. The vents 112 may be distributed at different locations within the walls of the mobile living unit 100 so the heated air flows out into the interior space. The heating system may include one or more convectors 118 extending continuously along the entire perimeter of the conditioned basement 110 of the mobile living unit 100. A hatch 116 may be located in the wall 102 allowing outside air to be received in the conditioned basement 110.

The present invention provides a novel approach for the flow and heating of air in a mobile living unit 100. As shown in FIG. 3, the wall 102 may be comprised of a plurality of studs 128 spaced 12-16 inches apart and an interior skin 130 secured to the studs 128 forming the interior wall surface 102*b* of the wall 102. According to one example, the interior skins may be made of metal.

A cross section of the wall 102, according to one embodiment, is shown in FIG. 4. In one example, the exterior wall surface 102*a* may comprise building insulation 124 where an inch of building insulation is located on the exterior portion and two (2) inches of rigid closed cell foam on the interior portion. A gap 126 is located between the building insulation 124 and the interior wall surface 102*b* providing a space for air to flow up from the conditioned basement 110, up through the wall 102 where it passes through the various vented locations in the wall 102 and out into the interior space of the mobile living unit 100. In one example, the gap 126 may be approximately 0.5 inches. As shown in FIG. 3, for example, a vent 112 is located below a window 114 in the wall 102.

As the gap 126 is bordered by insulation, the warm air is thermally protected from outside environments creating an entire building envelope of walls. The exterior walls of the mobile living unit 100 are warmed and radiate heat into the gap 126 as heat naturally rises.

According to one embodiment, the convectors 118 may be located continuously along the entire perimeter of the mobile living unit 100, underneath the structural system for the raised floor drawing air up the wall.

By this placement, cold air is funneled from the conditioned basement 110, to the convector 118 where it is converted to warm air which naturally rises up through the gap 126 in the wall (i.e., wall cavity) and through the vents 112. In the example shown, a warm screen of air is created in front of the windows creating warmth inside the wall sheet metal surface of the finished wall so any point along the entire trailer, that area would be warm creating homogenous and consistent warm air by radiating passively through the entire system. The system operates continuously by constantly rotating air through the building envelope radiating heat inside the mobile living unit.

Turning to FIG. 5, a cross-sectional view of a hydronic heating system in a mobile living unit according to one embodiment is illustrated. As shown, the mobile living unit 100 includes a raised floor 151 which extends parallely above the bottom surface of the mobile living unit 100 between the walls of the mobile living unit 100, only one of which is shown. The bottom surface may comprise one or more floor joists 154 extending horizontally between the walls in the mobile living unit. A space, area, or conditioned basement 155 is located below the raised floor 151. In one example, the conditioned basement 155 is located next to the one or more floor joists. Located within the conditioned basement 155 are the utilities and infrastructure of the mobile living unit 100. The utilities and infrastructure may include, but are not limited to, plumbing and electrical to allow the mobile living unit 100 to be utilized during all four seasons of the year. That is, the mobile living unit 100 can be used during the Winter, Spring, Summer, and Fall seasons.

In this embodiment, the wall may be comprised of a plurality of studs 140 spaced 12-16 inches apart. Insulation 146, 158 may be located between the studs in the wall and an exterior skin 146 of anodized aluminum, or other metal, may be used as an exterior wall surface on the exterior of the mobile living unit 100.

A support member 156 may be connected to the studs 140 in the wall of the mobile living unit 100. In one embodiment, the support member 156 may be made of metal, such as aluminum, and secured in place to the studs 140 and/or floor joists 154. In one example the support member 156 may be welded in place.

A convector 160 may be located in the conditioned basement 155 on the support member 156 and run along perimeter of the mobile living unit 100. The convector 160 may run continuously along the perimeter of the mobile living unit 100. As described previously, the convector 160 may include a pipe or tube extending longitudinally through a plurality of radiator fins. An open area is located around the convector 160 to allow for the flow of air and additional insulation 162 is located between the convector and a vertical member of the support panel 156.

The convector 160 draws in cold air funneled from the conditioned basement 155, converts the cold air to warm air which then naturally rises up through one or more hollow members, such as aluminum tube spacers 153, extending vertically up the wall and then out vents located within the walls, as described above. An interior wall surface is formed by an interior skin 144 and covers the one or more hollow members, such as aluminum tube spacers 153. The interior skin 144 may be formed of aluminum or other metal.

An access panel 150 may be detachably secured to the interior skin 144 and the raised floor 151. In one embodiment, the access panel may comprise a first panel member integrally connected to a second panel member where the first panel member is perpendicular to the second panel member. The first panel member extends horizontally outward and is secured to the raised floor 151 by a rivet 152 or other attachment member while the second panel member extends vertically upwards and is secured to the interior wall surface 144 by a screw 148 or other attachment member. The access panel 150 may be detached allowing access to the conditioned basement 155 and the convector 160.

As the hollow members 153 are bordered by insulation, the warm air emitted from the convector 160 is thermally protected from outside environments creating an entire building envelope of walls. The exterior walls of the mobile living unit 100 are warmed and radiate heat into the hollow members 153 as heat naturally rises.

By this unique structure, cold air is funneled from the conditioned basement, converted to warm air which naturally rises through the hollow members in the wall and then out the vents 112 located within the walls. The interior skins 144 on the wall, made of sheet metal, would be warmed creating a very homogenous and consistent warm air by radiating passively through the entire system.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A mobile living unit, comprising:

a roof;

a bottom surface including one or more floor joists;

a plurality of walls integrally connected and extending between the roof and the one or more floor joists forming an interior space, at least one wall in the plurality of walls comprising:

a plurality of studs;

an exterior wall surface secured to an outer surface of the studs;

insulation located between studs in the plurality of studs;

one or more hollow members extending vertically upward along the insulation;

an interior wall surface secured to the hollow member; and one or more vents located within the interior wall surface;

a raised floor extending parallely above the bottom surface between plurality of walls;

a conditioned basement located below the raised floor;

a support member connected to the plurality of studs and the one or more floor joists; and at least one convector located within the conditioned basement and secured to the support member.

2. The mobile living unit, wherein the one or more hollow members are aluminum tube spacers.

3. The mobile living unit of claim 1, further comprising an access panel detachably secured to the interior skin and the interior wall surface and the raised floor.

4. The mobile living unit of claim 1, wherein the outer wall surface is comprised of anodized aluminum.

5. The mobile living unit of claim 1, wherein the inner wall surface is comprised of aluminum.

6. The mobile living unit of claim 1, wherein air flows from the conditioned basement, through the convector, up through the hollow member and out the plurality of vents, heating an interior space.

7. The mobile living unit of claim 1, wherein air is drawn into the convector from between the floor joists warming a floor in an interior space.

8. The mobile living unit of claim 1, wherein the at least one convector comprises:

a plurality of radiator fins; and a tube extending through the radiator fins, where glycol flows though the hollow member to heat the air from the conditioned basement.

9. The mobile living unit of claim 1, wherein the conditioned basement house plumbing and utilities.

10. A mobile living unit, comprising:

a roof;

a bottom;

a plurality of walls integrally connected and extending between the roof and bottom surface forming an interior space;

a plurality of vents located within the plurality of walls;

a raised floor extending transversely across the bottom surface and between the plurality of walls;

a conditioned basement located between the bottom surface and the raised floor;

at least one convector located within the conditioned basement;

wherein each wall in the plurality of walls has an interior surface and an opposing exterior surface;

wherein building insulation is located between the exterior surface and the interior surface;

wherein a gap is formed between the building insulation and the interior surface; and wherein air flows from the conditioned basement, through the convector, up through the gap and out the plurality of vents, heating the interior space.

11. The mobile living unit of claim 1, wherein the at least one convector comprises:

a plurality of radiator fins; and a tube extending through the radiator fins, glycol flowing though the tube to heat the air from the conditioned basement.

12. The mobile living unit of claim 1, wherein the conditioned basement house plumbing and utilities.

* * * * *